US009290353B2

(12) United States Patent
Deguchi et al.

(10) Patent No.: US 9,290,353 B2
(45) Date of Patent: Mar. 22, 2016

(54) PAPER MONEY ACCUMULATION DEVICE

(71) Applicant: FUJITSU FRONTECH LIMITED, Inagi-shi, Tokyo (JP)

(72) Inventors: Shoichi Deguchi, Inagi (JP); Hiroshi Yanagida, Inagi (JP); Shohei Koizumi, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 0 days.

(21) Appl. No.: 14/662,993

(22) Filed: Mar. 19, 2015

(65) Prior Publication Data

US 2015/0266688 A1 Sep. 24, 2015

(30) Foreign Application Priority Data

Mar. 24, 2014 (JP) ..... 2014-060923

(51) Int. Cl.

| | |
|---|---|
| ***B65H 5/22*** | (2006.01) |
| ***B65H 29/00*** | (2006.01) |
| ***B65H 29/14*** | (2006.01) |
| ***B65H 31/02*** | (2006.01) |
| ***B65H 31/30*** | (2006.01) |

(52) U.S. Cl.

CPC ..... *B65H 29/006* (2013.01); *B65H 29/14* (2013.01); *B65H 31/02* (2013.01); *B65H 31/3027* (2013.01); *B65H 2301/4212* (2013.01); *B65H 2301/4223* (2013.01); *B65H 2404/1114* (2013.01); *B65H 2404/14* (2013.01); *B65H 2404/2614* (2013.01); *B65H 2404/63* (2013.01); *B65H 2405/1111* (2013.01); *B65H 2405/1116* (2013.01); *B65H 2701/1912* (2013.01)

(58) Field of Classification Search

CPC ..... G07D 13/00; B65H 31/04; B65H 31/14; B65H 2301/423

USPC ..... 271/3.01, 3.08, 3.09; 194/206, 207; 235/379; 382/135; 209/534; 414/792.7, 414/794.4, 789.9, 790.7, 794.5, 794.6

See application file for complete search history.

(56) References Cited

U.S. PATENT DOCUMENTS

| | | | | |
|---|---|---|---|---|
| 3,761,080 | A * | 9/1973 | Larson | 271/209 |
| 4,799,663 | A * | 1/1989 | Golicz | 271/199 |
| 4,828,243 | A * | 5/1989 | Ebihara | 271/315 |
| 5,375,825 | A * | 12/1994 | Kennish | 270/58.02 |
| 5,836,577 | A * | 11/1998 | Arikawa et al. | 270/58.04 |
| 5,927,936 | A * | 7/1999 | Arikawa et al. | 414/788 |
| 6,607,189 | B2 * | 8/2003 | Cost et al. | 271/3.08 |
| 7,635,121 | B2 * | 12/2009 | Dobashi et al. | 270/45 |
| 7,784,777 | B2 * | 8/2010 | Dobashi et al. | 270/46 |
| 7,845,628 | B2 * | 12/2010 | Dobashi et al. | 270/58.17 |
| 2011/0132718 | A1 * | 6/2011 | Park et al. | 194/206 |

FOREIGN PATENT DOCUMENTS

| | | |
|---|---|---|
| JP | 10-291710 | 11/1998 |
| JP | 2001-143128 | 5/2001 |
| JP | 2003-226442 | 8/2003 |

* cited by examiner

*Primary Examiner* — Thomas Morrison
(74) *Attorney, Agent, or Firm* — Staas & Halsey LLP

(57) ABSTRACT

In a paper money accumulation unit (paper money accumulation device) of a paper money handling device, rollers sequentially input paper money from an upper side into a paper money accumulation space. Then, a support member is arranged in a state where the height with respect to an extended line of an input direction becomes large as being away from the rollers to the input direction of the paper money.

3 Claims, 11 Drawing Sheets

PAPER MONEY ACCUMULATION DEVICE

CROSS-REFERENCE TO RELATED APPLICATION(S)

This application is based upon and claims the benefit of priority of the prior Japanese Patent Application No. 2014-060923, filed on Mar. 24, 2014, the entire contents of which are incorporated herein by reference.

FIELD

The embodiments discussed herein are related to a paper money accumulation device.

BACKGROUND

Conventionally, as paper money handling devices, there are automated teller machines (ATMs), paper money depositing/dispensing devices installed at bank counters, self-checkout registers installed in supermarkets and used for performing settlement by customers themselves, and the like.

The paper money handling devices may sometimes include a "temporary holding unit (holding device)" that temporarily holds paper money. As the temporary holding unit, for example, there is one that sandwiches the paper money between a pair of films, and winds up the pair of films that sandwich the paper money, thereby to store the paper money. At the time of ejecting the paper money, such a temporary holding unit can eject the stored paper money by rotating a winding roller in a reverse direction to the direction of when the paper money was stored.

Further, some of the paper money handling devices include a "dispensing paper money accumulation unit (paper money accumulation device)" that accumulates a plurality of sheets of paper money to be returned in a space for accumulating paper money (hereinafter, may be referred to as "paper money accumulation space"), and collectively discharges the plurality of accumulated sheets of paper money through an output port. At the time of paying out the paper money, and when the paper money is returned to a customer for change or cancellation of transaction, the paper money to be output is accumulated in the dispensing paper money accumulation unit. For example, as the dispensing paper money accumulation unit, there is one that includes a stage, which is positioned at a first position at a lower side of the paper money accumulation space at the time of inputting the paper money, is raised to a second position from the first position at the time of outputting the paper money, and lifts the accumulated paper money. Then, such a dispensing paper money accumulation unit includes an output conveyance unit including a first conveyance unit provided at the stage, and a second conveyance unit that moves the paper money to the output port in a state of sandwiching the raised paper money with the first conveyance unit when the stage is raised to the second position. Conventional examples are described in Japanese Laid-open Patent Publication No. 2001-143128

However, when first paper money having curling habit is input to the dispensing paper money accumulation unit, the first paper money may be squashed and bent by the weight of other sheets of paper money input afterward. Especially, in the paper money handling device including the above-described temporary holding unit that sandwiches the paper money between a pair of films, a possibility that the paper money forms the curling habit becomes high. Further, as described above, in the dispensing paper money accumulation unit that outputs the paper money through the output port in a state of sandwiching the paper money between the first conveyance unit and the second conveyance unit, the possibility that the paper money having the curling habit is bent due to not only the weight of the paper money but also pressing force at the time of being sandwiched becomes high. Note that this problem is not limited to the dispensing paper money accumulation unit, and is common to paper money accumulation units used for other use.

As described above, when the paper money is bent in the paper money handling device, a jam or the like is caused, and becomes a cause to cause the paper money handling device to be in a non-usable state. As a result, the convenience of the user may be deteriorated.

SUMMARY

According to an aspect of an embodiment, a paper money accumulation device includes an input unit that sequentially inputs paper money into a space for accumulating the paper money; and a holding unit that includes a support member arranged in a state where a height with respect to an extended line of an input direction becomes large as being away from the input unit to the input direction of the paper money at a time of inputting the paper money, and that is positioned at a lower side of the space and holds the input paper money with the support member.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Preferred embodiments of the present invention will be explained with reference to accompanying drawings. Note that the paper money accumulation device disclosed by the present application is not limited by the embodiments. Further, description will be given on the assumption that a paper money handling device including the paper money accumulation device is a self-checkout register as an example. However, the paper money handling device is not limited to the example. Further, hereinafter, description will be given on the assumption that the paper money accumulation device is a dispensing paper money accumulation unit provided in the paper money handling device. Further, configurations having the same function are denoted with the same reference sign, and overlapping description is omitted in the embodiment.

First Embodiment

Configuration Example of Paper Money Collecting Device

Figure 1:
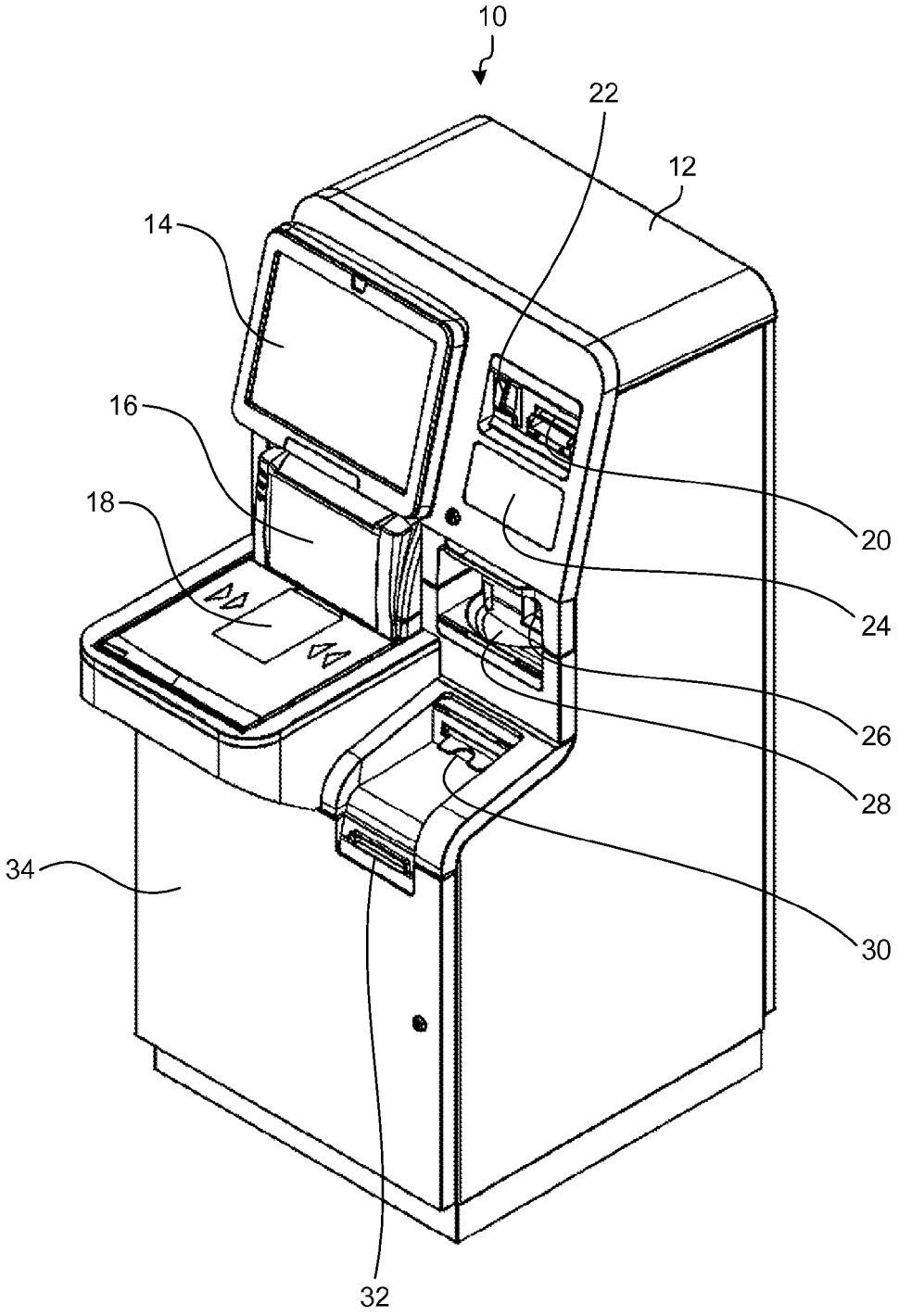
FIG. 1 is a diagram illustrating an appearance example of a paper money handling device including a paper money accumulation device of a first embodiment.

FIG. 1 is a diagram illustrating an appearance example of a paper money handling device including a paper money accumulation device of a first embodiment. In FIG. 1, a paper money handling device 10 includes a device housing 12. FIG. 1 is a perspective view of the paper money handling device 10, as viewed from obliquely upper right. That is, in FIG. 1, a side to which a touch panel 14 is attached is "front" of the paper money handling device 10.

The touch panel 14 is arranged at a left-side upper position on a front surface of the device housing 12. The touch panel 14 displays various types of information presented to the user, and receives an operation by the user.

A scanner 16 is arranged at a lower side of the touch panel 14, on the front surface of the device housing 12. When a code symbol attached to a product that a customer desires to purchase (that is, a purchase-desired product) is held over the scanner 16, the scanner 16 reads information of the code symbol, and outputs the read information to a control unit (not illustrated). Note that the code symbol is a one-dimensional barcode, a two-dimensional barcode, or the like.

A scale unit 18 rising from the front surface of the device housing 12 is provided at a lower-side position of the scanner 16. The scale unit 18 measures the weight of the purchase-desired product placed by the user, and outputs information related to the measured weight to the control unit (not illustrated). Accordingly, the control unit (not illustrated) can perform "check processing" of determining whether the product, the information of which has been read by the scanner 16, and the product, the weight of which has been measured, are matched.

Further, a paper money insertion slot 20 and a coin insertion slot 22 are arranged and provided side by side at a right-side upper portion on the front surface of the device housing 12. The paper money insertion slot 20 and the coin insertion slot 22 are used when the customer pays a payable charge. The paper money of the payable charge is inserted into the paper money insertion slot 20. Further, coins of the payable charge are inserted into the coin insertion slot 22.

A card reader 24 is arranged at a lower-side position of the paper money insertion slot 20 and the coin insertion slot 22 on the front surface of the device housing 12.

A receipt issuance port 26 and a coin discharge port 28 are arranged at lower-side positions of the card reader 24 on the front surface of the device housing 12. At the time of completion of settlement, a receipt is discharged through the receipt issuance port 26. Further, at the time of completion of settlement and at the time of cancellation of transaction, coins that are objects for change and to be returned are discharged through the coin discharge port 28.

A paper money discharge port 30 is provided at a lower-side position of the receipt issuance port 26 and the coin discharge port 28 on the front surface of the device housing 12. At the time of completion of settlement and at the time of cancellation of transaction, the paper money that is an object for change and to be returned are discharged through the paper money discharge port 30.

A coupon insertion slot 32 is provided at a lower-side position of the paper money discharge port 30 on the front surface of the device housing 12. A door 34 is provided at a lower side of the coupon insertion slot 32. An administrator opens the door 34, and takes out the paper money collected in a collecting unit 52 described below, for example.

Figure 2:
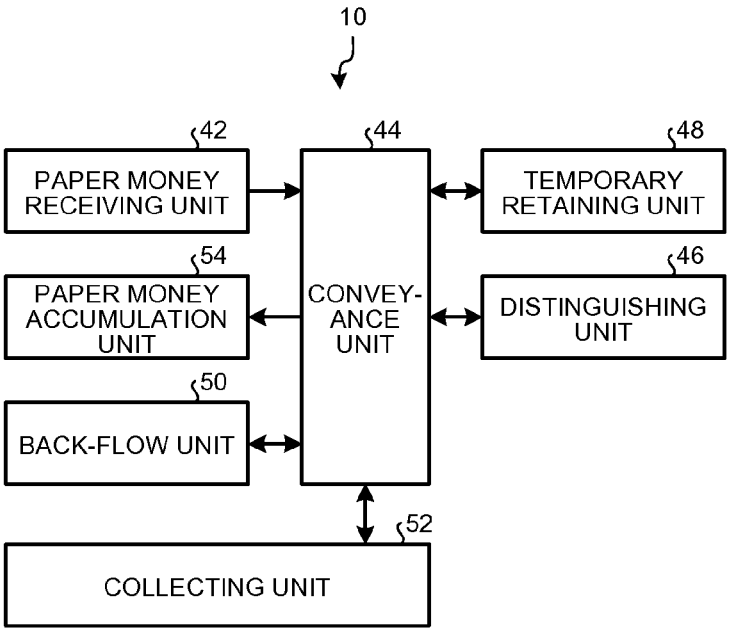
FIG. 2 is a schematic diagram illustrating an example of the paper money handling device of the first embodiment.

FIG. 2 is a schematic diagram illustrating an example of the paper money handling device of the first embodiment. FIG. 2 illustrates principal configurations of the paper money handling device 10, and especially illustrates configurations related to receiving and discharging of the paper money. In FIG. 2, the paper money handling device 10 includes a paper money receiving unit 42, a conveyance unit 44, a distinguishing unit 46, a temporary retaining unit 48, a back-flow unit 50, the collecting unit 52, and a paper money accumulation unit (paper money accumulation device) 54.

The paper money receiving unit 42 receives the paper money inserted through the paper money insertion slot 20, and sends the received paper money to the conveyance unit 44.

The conveyance unit 44 is connected to the paper money receiving unit 42, the distinguishing unit 46, the temporary retaining unit 48, the back-flow unit 50, and the collecting unit 52. Further, the conveyance unit 44 includes a plurality of types of conveyance path forming parts including a conveyance guide, a roller, a drive motor, and a route switching gate. A conveyance path is formed of the plurality of types of conveyance path forming parts. Then, the conveyance unit 44 conveys the paper money inserted into the paper money insertion slot 20 to the temporary retaining unit 48 through the distinguishing unit 46 one by one. Then, when the cancellation of transaction or the like is not made by the customer, the conveyance unit 44 conveys the paper money retained by the temporary retaining unit 48 to the back-flow unit 50 one by one.

The distinguishing unit 46 distinguishes whether the conveyed paper money is normal paper money or "rejected paper money". Then, for example, while the normal paper money is retained in the temporary retaining unit 48 via the conveyance unit 44, the "rejected paper money" is discharged through the paper money discharge port 30 via the paper money accumulation unit 54. The "rejected paper money" is abnormal money, which is the normal paper money but is not able to be recognized as the normal paper money, such as dirty paper money, damaged paper money, or bent paper money.

The temporary retaining unit 48 temporarily retains (stores) the paper money conveyed by the conveyance unit 44, and ejects the temporarily retained paper money to the conveyance unit 44.

Figure 3:
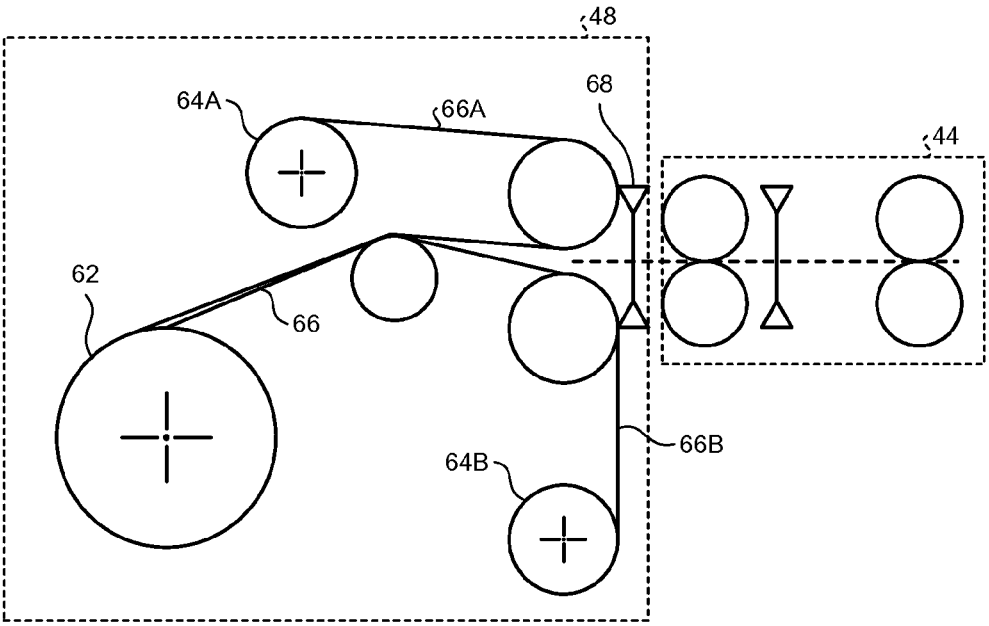
FIG. 3 is a schematic diagram illustrating an example of a temporary retaining unit of the first embodiment.
Figure 4:
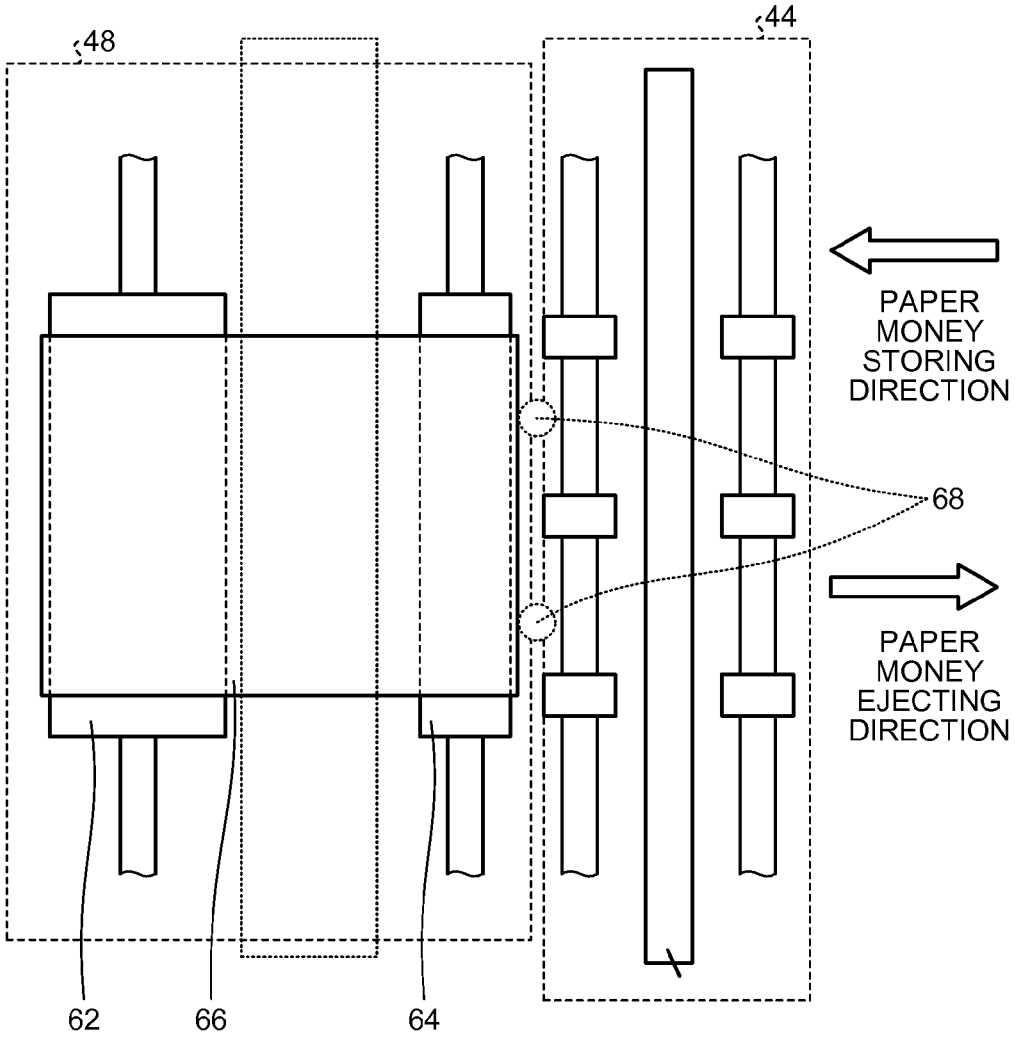
FIG. 4 is a schematic diagram illustrating an example of the temporary retaining unit of the first embodiment.

FIGS. 3 and 4 are schematic diagrams illustrating an example of the temporary retaining unit of the first embodiment. FIG. 3 is a cross-sectional view of the temporary retaining unit, and FIG. 4 is a diagram of the temporary retaining unit as viewed from above. Note that a configuration of a part of the conveyance unit 44 is illustrated in FIGS. 3 and 4 for convenience.

The temporary retaining unit 48 includes a paper money winding roller 62 and winding film rollers 64A and 64B. At the time of storing the paper money by the temporary retaining unit 48, the paper money winding roller 62 is rotated in a direction of winding a film 66 in which a pair of films 66A and 66B are layered, and with the rotation, the winding film rollers 64A and 64B are respectively rotated in directions of sending the films 66A and 66B. In the temporary retaining unit 48, the paper money to be housed is sandwiched between the film 66A and the film 66B sent from the winding film rollers 64A and 64B. Then, the pair of films 66A and 66B is wound by the paper money winding roller 62 while maintaining the state of sandwiching the paper money. In this way, the temporary retaining unit 48 houses the paper money conveyed by the conveyance unit 44.

Meanwhile, at the time of ejecting the paper money by the temporary retaining unit 48, the paper money winding roller 62 and the winding film rollers 64A and 64B are reversely rotated to the direction of when the paper money was stored. That is, the winding film rollers 64A and 64B are respectively rotated in directions of winding the films 66A and 66B, and with the rotation, the paper money winding roller 62 is rotated in a direction of sending the film 66. Accordingly, the paper money sandwiched between the film 66A and the film 66B is moved toward the conveyance unit 44. Then, the film 66A and the film 66B are separated, so that the paper money is released from the state of being sandwiched between the film 66A and the film 66B, from a tip end side of the paper money, and is ejected to the conveyance unit 44.

Further, the temporary retaining unit 48 includes an exit/entrance sensor 68. The exit/entrance sensor 68 detects the paper money conveyed by the conveyance unit 44, and notifies a detection result to the control unit (not illustrated). Then, by the control of the control unit (not illustrated), the paper money winding roller 62 and the winding film rollers 64A and 64B perform the rotation operation at the time of storing the paper money, whereby the paper money conveyed by the conveyance unit 44 is stored. Note that, at the time of ejection, by the control of the control unit (not illustrated), the paper money winding roller 62 and the winding film rollers 64A and 64B perform the rotation operation at the time of ejection, whereby the stored paper money is ejected to the conveyance unit 44.

Referring back to FIG. 2, the back-flow unit 50 stores the paper money inserted through the paper money insertion slot 20, and received via the paper money receiving unit 42, the distinguishing unit 46, the temporary retaining unit 48, and the conveyance unit 44. Further, when having received a money dispensing order from the control unit (not illustrated), the back-flow unit 50 sends out the paper money corresponding to a denomination and the number of sheets indicated by the money dispensing order to the conveyance unit 44. The sent-out paper money is discharged through the paper money discharge port 30 via the conveyance unit 44, the distinguishing unit 46, the temporary retaining unit 48, and the paper money accumulation unit 54. In this way, the deposited paper money can be used as the dispensed paper money by the back-flow unit 50. That is, the back flow of the paper money becomes possible by the back-flow unit 50.

The collecting unit 52 receives and stores the paper money sent out from the back-flow unit 50 at the time of processing of collecting the paper money via the conveyance unit 44. The paper money stored in the collecting unit 52 is collected by the administrator, whereby the administrator can easily collect the paper money.

The paper money accumulation unit (paper money accumulation device) 54 accumulates the paper money for dispensing in the "paper money accumulation space", and discharges (outputs) the accumulated paper money through the paper money discharge port 30.

Figure 5:
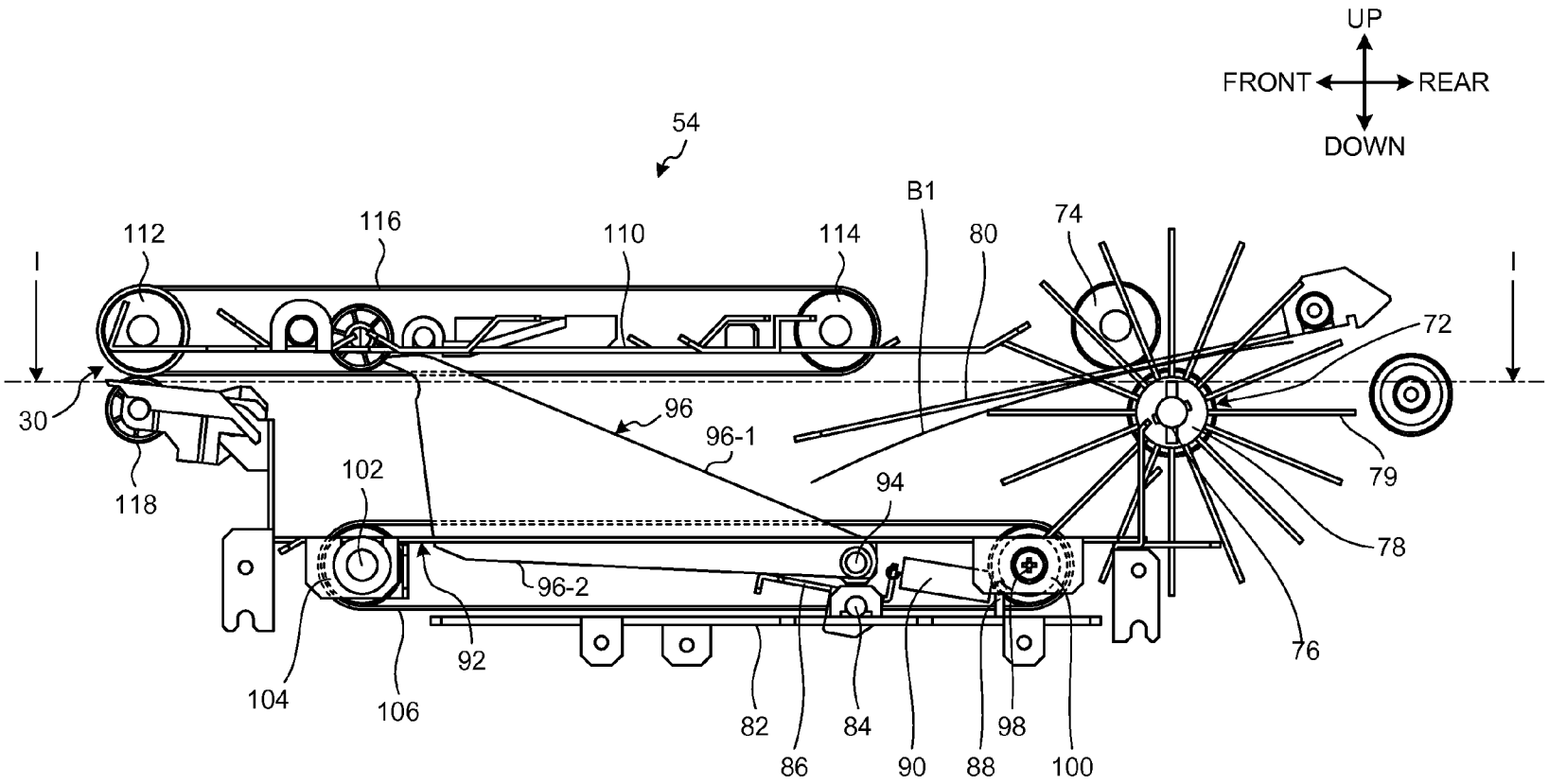
FIG. 5 is a diagram illustrating an example of a paper money accumulation unit of the first embodiment.
Figure 6:
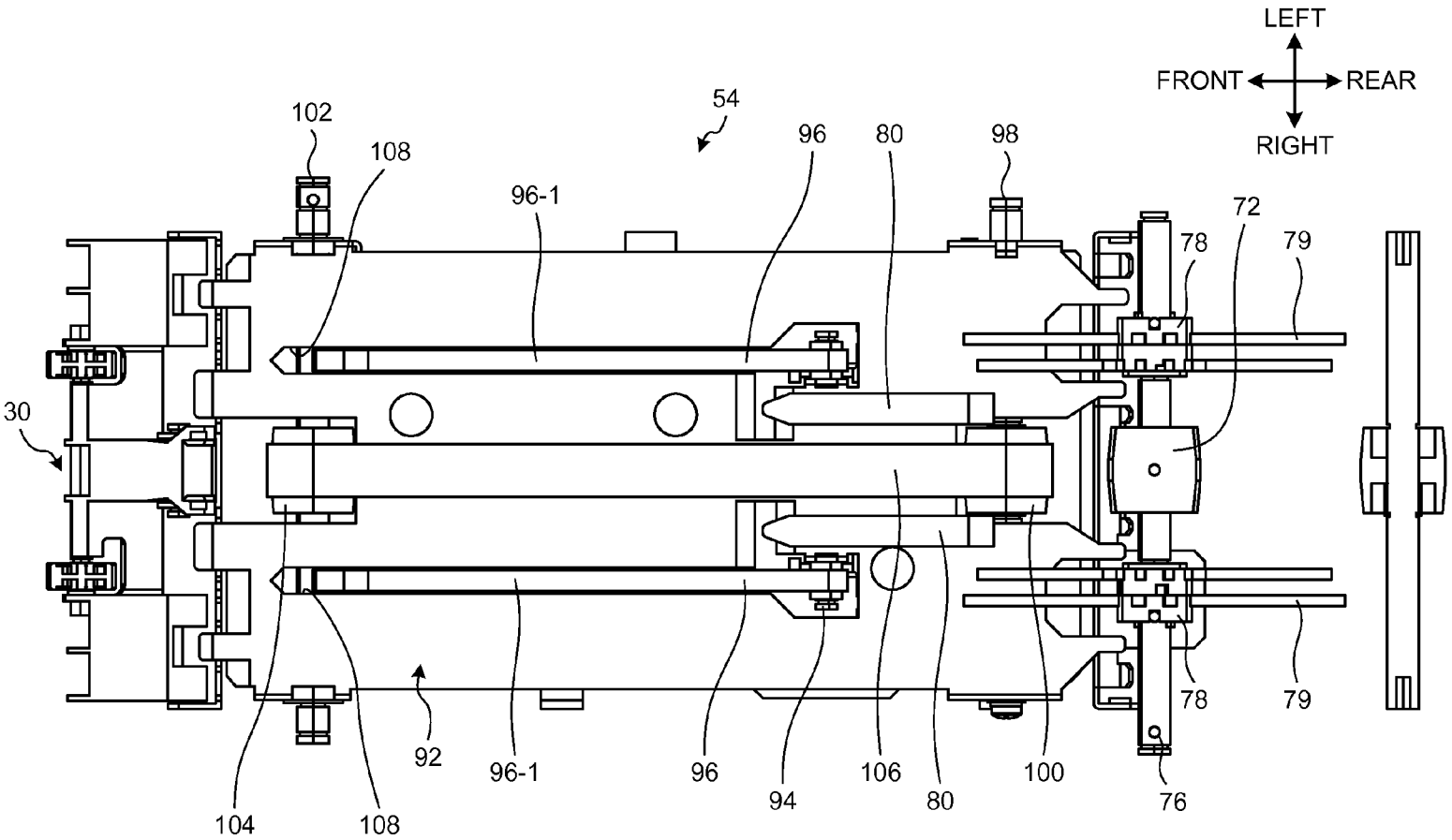
FIG. 6 is a diagram illustrating an example of the paper money accumulation unit of the first embodiment.

FIGS. 5 and 6 are diagrams illustrating an example of the paper money accumulation unit of the first embodiment. FIG. 5 is a schematic diagram of the paper money accumulation unit as viewed from a right side of the paper money handling device 10. That is, left of FIGS. 5 and 6 is "front" of the paper money accumulation unit, right of FIGS. 5 and 6 is "rear" of the paper money accumulation unit, up of FIG. 6 is "left of the paper money accumulation unit, and down of FIG. 6 is "right" of the paper money accumulation unit. Further, up of FIG. 5 is "up" of the paper money accumulation unit, and down of FIG. 5 is "down" of the paper money accumulation unit. Further, FIG. 6 is an arrow cross-sectional view taken along a line I-I of the paper money accumulation unit.

A roller 72 is provided at an upper rear end portion of the paper money accumulation unit 54. The roller 72 is wound around a shaft 76, and is arranged in an approximately center of the paper money accumulation unit 54 in a right and left direction (that is, in a width direction). A roller 74 is arranged above the roller 72. The rollers 72 and 74 sequentially input the paper money conveyed by the conveyance unit 44 to the paper money accumulation space. That is, the rollers 72 and 74 function as an "input unit (input port)" that inputs the paper money to the paper money accumulation space.

A pair of bladed wheels 78 is arranged to the shaft 76 at both sides of the roller 72 across the roller 72. That is, the bladed wheels 78 are arranged at positions not to sterically interfere with the roller 74. Further, the bladed wheels 78 include a plurality of blades 79. These blades 79 downwardly hit a rear end portion of the paper money input to the paper money accumulation space by the input unit as the bladed wheels 78 are rotated with the rotation of the shaft 76.

A bar 80 is arranged to extend from the input port to a center of a front and rear direction of the paper money accumulation space, in a space between the roller 72 and the bladed wheels 78. The bar 80 presses down paper money B1 input through the input unit, thereby to stabilize an input direction of the paper money. That is, the bar 80 functions as a paper money input guide. Further, the bar 80 has a function to press down a bundle of paper money lifted by a stage 92 when the stage 92 described below is raised.

Further, a bottom plate 82 is arranged at a lower end portion of the paper money accumulation unit 54. An energization bar 86 having an approximate L shape, and supported by a shaft 84 is arranged on the bottom plate 82. One end portion of the energization bar 86 is connected with another end of a spring 90 fixed such that one end is hung from a fixed portion 88. The energization bar 86 and the spring 90 function as an "energization unit".

The stage 92 is arranged above the bottom plate 82. The stage 92 is configured to be movable in the up and down direction, and FIG. 5 illustrates a state where the stage 92 is lowered to a lowest point (hereinafter, may be referred to as "lowered state"). A support member 96 supported by a shaft 94 positioned above the shaft 84 is arranged on the stage 92. The support member 96 has an approximately right triangular shape, and the shaft 94 is arranged in the vicinity of one apex. The support member 96 and the shaft 94 function as a "holding unit" of the paper money. Then, a slope portion of the support member 96 (that is, slope portion 96-1) is arranged in a state where the height with respect to an extended line of the input direction becomes larger as being away from the input unit to the input direction of the paper money in the lowered state. That is, the support member 96 is arranged to become an ascending slope in the input direction of the paper money in the lowered state. Accordingly, even if the paper money having curling habit is input, the curling of the paper money can be prevented. Further, a base portion of the support member 96 (that is, a bottom portion 96-2) is in contact with the energization bar 86 in the lowered state. That is, the support member 96 is upwardly energized by the energization unit in the lowered state.

Further, a roller 100 is provided at a rear end portion of the stage 92. The roller 100 is attached to a shaft 98 extending in the right and left direction (that is, the width direction) of the stage 92, and is arranged in an approximately center of the right and left direction of the stage 92. Further, the roller 100 is arranged in a notch provided in the stage 92. Accordingly, a roller surface of the roller 100 is exposed.

Further, a roller 104 is provided at a front end portion of the stage 92. The roller 104 is attached to a shaft 102 extending in the right and left direction (that is, the width direction) of the stage 92, and is arranged in an approximately center of the right and left direction of the stage 92. Further, the roller 104 is arranged in a notch provided in the stage 92. Accordingly, a roller surface of the roller 104 is exposed.

The rollers 100 and 104 are passed through a ring portion of a ring-shaped conveyance belt 106. That is, the conveyance belt 106 is round around both of the rollers 100 and 104, and extending in the front and rear direction of the stage 92. Therefore, the rollers 100 and 104 are rotated with the rotation of the shafts 98 and 102, thereby the conveyance belt 106 goes around outsides of the rollers 100 and 104. Accordingly, an object to be conveyed (paper money) being in contact with the conveyance belt 106 can be conveyed in the front and rear direction of the stage 92. That is, the rollers 100 and 104, and the conveyance belt 106 form a "lower-side conveyance unit".

Further, notched portions 108 are provided at both sides of the conveyance belt 106, interposing the conveyance belt 106 at an approximately center, in the stage 92. The notched portion 108 is provided in a portion positioned under the support member 96, of the stage 92. The notched portion 108 is provided such that the support member 96 can slip through the stage 92 when the support member 96 is rotated around the shaft 94 as a rotation shaft with the stage 92 being raised.

Further, a ceiling plate 110 is arranged at an upper end portion of the paper money accumulation unit 54. A roller 112 is provided at a front end portion of the ceiling plate 110, that is, at an upper front end portion of the paper money accumulation unit 54. Meanwhile, a roller 114 is provided at a rear end portion of the ceiling plate 110. Then, a conveyance belt 116 is wound around the rollers 112 and 114. The conveyance belt 116 extends in the front and rear direction of the ceiling plate 110. Therefore, by rotation of the rollers 112 and 114, the conveyance belt 116 goes around outsides of the rollers 112 and 114. Accordingly, an object to be conveyed (paper money) being in contact with the conveyance belt 116 can be conveyed in the front and rear direction of the ceiling plate 110. That is, the rollers 112 and 114, and the conveyance belt 116 form an "upper-side conveyance unit".

Here, when an intended number of the paper money is layered in the paper money accumulation space, the stage 92 is raised by the control of the control unit (not illustrated), and lifts the layered paper money. Then, when the stage 92 is further raised, the lifted paper money is sandwiched between the "upper-side conveyance unit" and the "lower-side conveyance unit". The paper money sandwiched between the "upper-side conveyance unit" and the "lower-side conveyance unit" is moved toward the paper money discharge port 30 by causing the conveyance belts 106 and 116 to go around. That is, the "upper-side conveyance unit" and the "lower-side conveyance unit" form an "output conveyance unit". Note that the state where the stage 92 is raised may be referred to as "raised state".

Further, a roller 118 is provided below the roller 112. The rollers 118 and 112 send out the paper money conveyed by the "upper-side conveyance unit" and the "lower-side conveyance unit" to the paper money discharge port 30. That is, the rollers 118 and 112 function as an "output unit (output port)".

An Operation Example of a Paper Money Accumulation Device

An operation example of a paper money accumulation device having the above configuration will be described. Here, especially, an operation example of the paper money accumulation unit 54 will be descried. FIGS. 7 to 12 are explanatory diagrams of an operation of the paper money accumulation unit.

Figure 7:
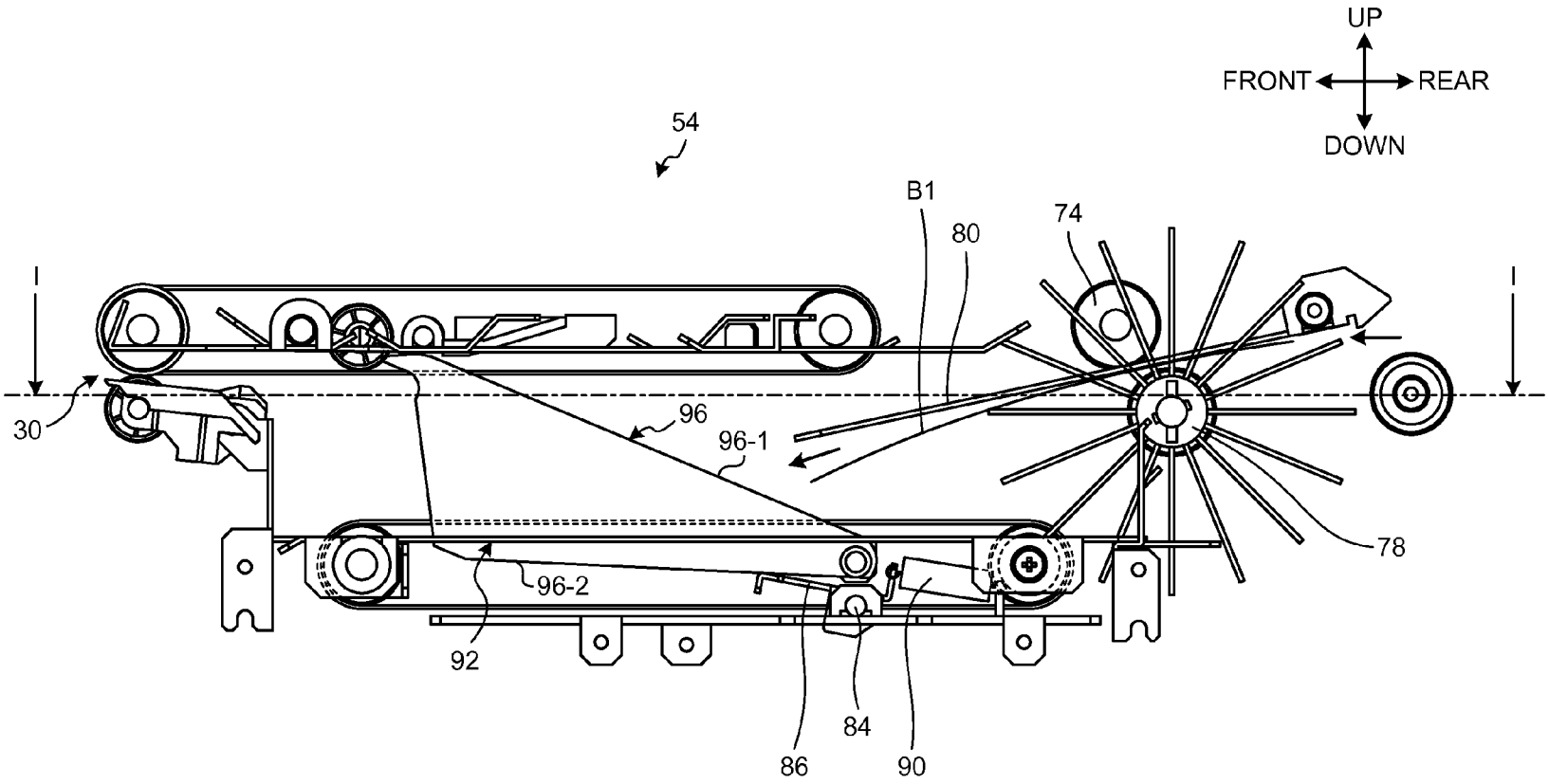
FIG. 7 is an explanatory diagram of an operation of the paper money accumulation unit.

First, accumulation processing of the paper money with respect to the paper money accumulation unit 54 is started, the first paper money B1 is input to the paper money accumulation space from the input unit including the rollers 72 and 74, as illustrated in FIG. 7. As illustrated in FIG. 7, during the accumulation processing of the paper money, the stage 92 is in the "lowered state".

Figure 8:
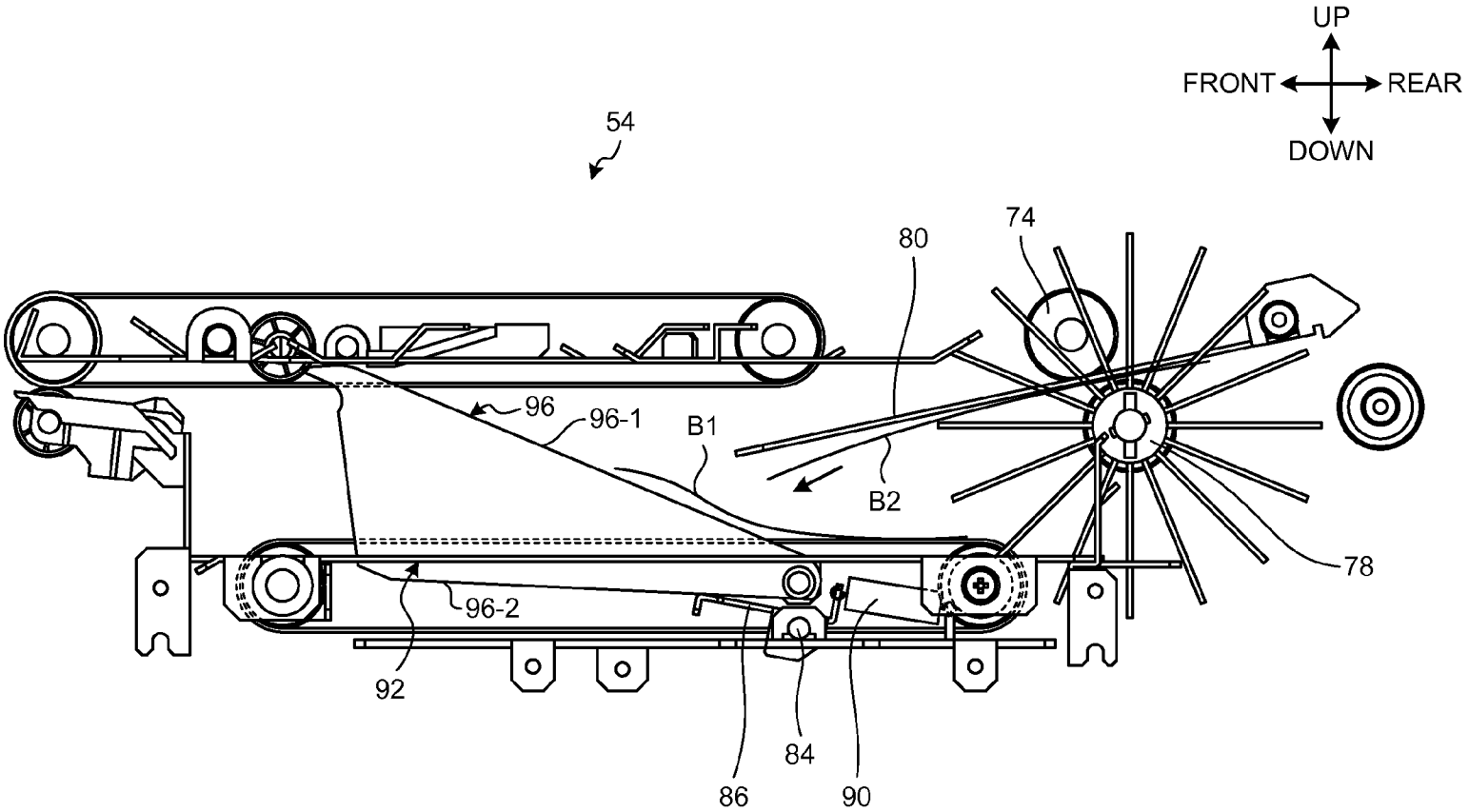
FIG. 8 is an explanatory diagram of an operation of the paper money accumulation unit.
Figure 9:
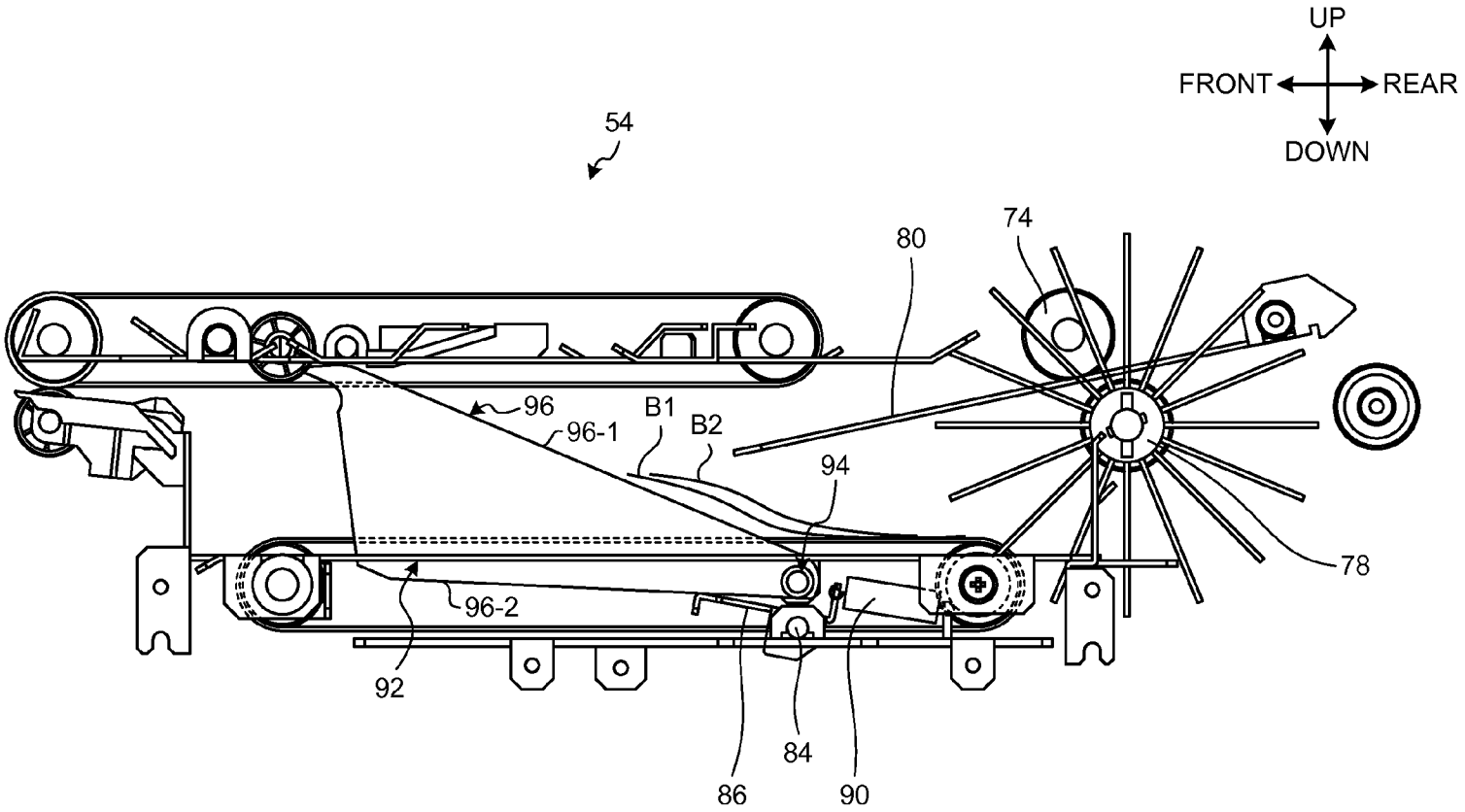
FIG. 9 is an explanatory diagram of an operation of the paper money accumulation unit.

Then, the accumulation processing of the paper money is continued until an intended number of accumulation N of the paper money is accumulated. FIG. 8 illustrates a state in which the first paper money B1 is supported by the slope portion 96-1 of the support member 96 and the rear end portion of the "lower-side conveyance unit", and the second paper money B2 is input. That is, a head portion of the paper money B1, which is first input from the input unit, is supported by the slope portion 96-1 of the support member 96, and a rear portion of the paper money B1 is supported by the rear end portion of the "lower-side conveyance unit". That is, here, the "holding unit" includes the rear end portion of the "lower-side conveyance unit". Further, FIG. 9 illustrates a state in which the first paper money B1 and the second paper money B2 are supported by the slope portion 96-1 of the support member 96.

Figure 10:
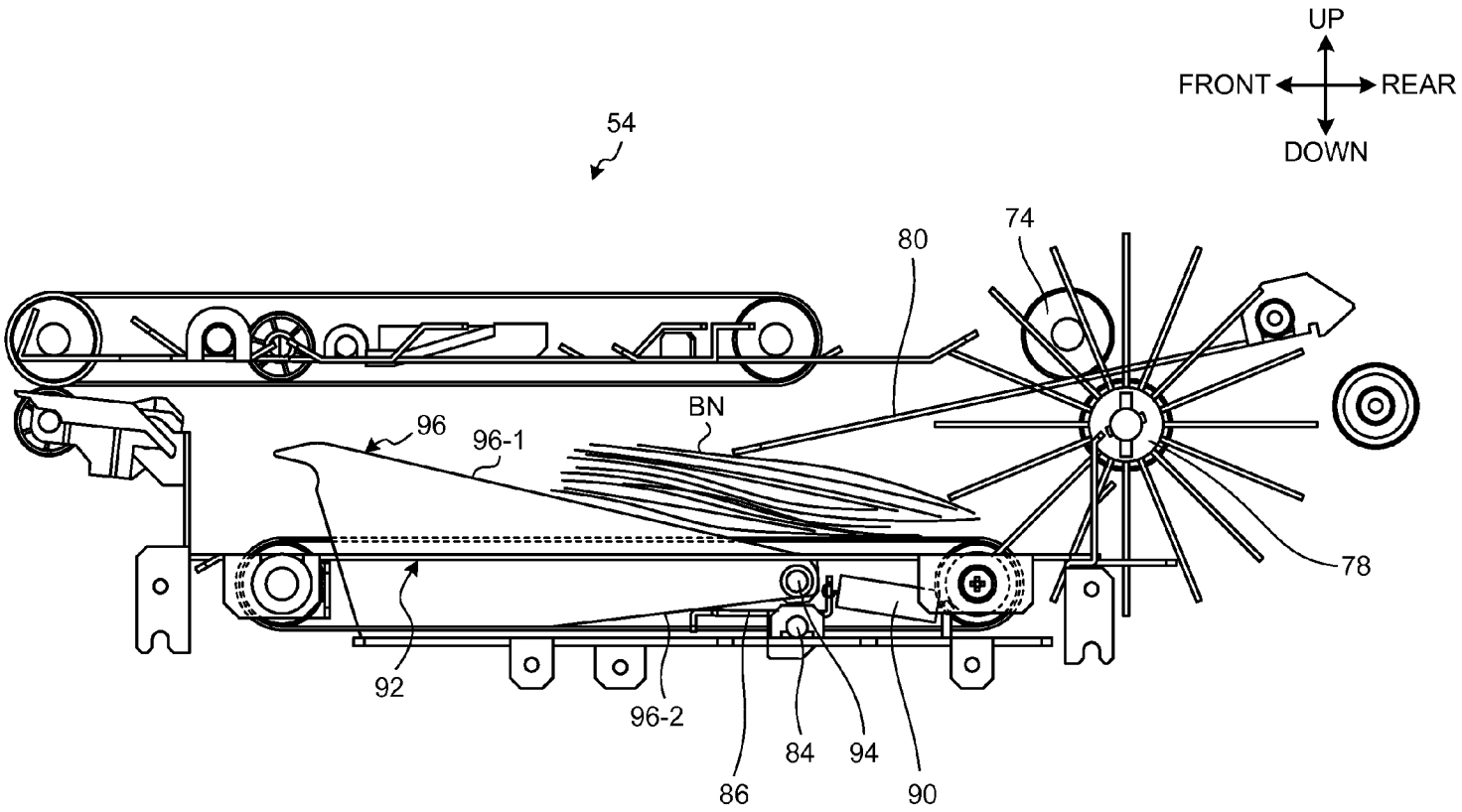
FIG. 10 is an explanatory diagram of an operation of the paper money accumulation unit.

When the number of accumulated paper money is increased, the tip end portion of the energization bar 86 is pressed down by the support member 96 according to the weight of the accumulated paper money until the weight and elastic force of the energization unit are balanced. That is, the energization unit rotates the support member 96 around the shaft 94, and moves the slope portion 96-1 of the support member 96 in a lower side direction, according to the weight of the paper money held by the paper money accumulation unit 54 in a state of being supported by the support member 96. At this time, the bottom portion 96-2 of the support member 96 slips through the notched portion 108 provided in the stage 92. FIG. 10 illustrates a state where the intended number of accumulation N has been accumulated.

When the accumulation processing of the paper money has been completed, ejection (output) processing of the paper money is started. When the ejection processing of the paper money has been started, rising of the stage 92 is started. The support member 96 eludes the energization by the energization unit and is rotated around the shaft 94 with the rising of the stage 92, and gradually slips through the notched portion 108. Accordingly, an angle made by an upper surface of the stage 92 and the slope portion 96-1 of the support member 96 becomes gradually small, and at the end, the upper surface of the stage 92 and the slope portion 96-1 of the support member 96 are positioned on approximately the same surface. Further, in the process of rising of the stage 92, the paper money layered on the support member 96 is pressed by the bar 80. Accordingly, an inclination of the support member 96 becomes gentle, and even if the paper money is easily curled, the curling of the paper money can be prevented.

Figure 11:
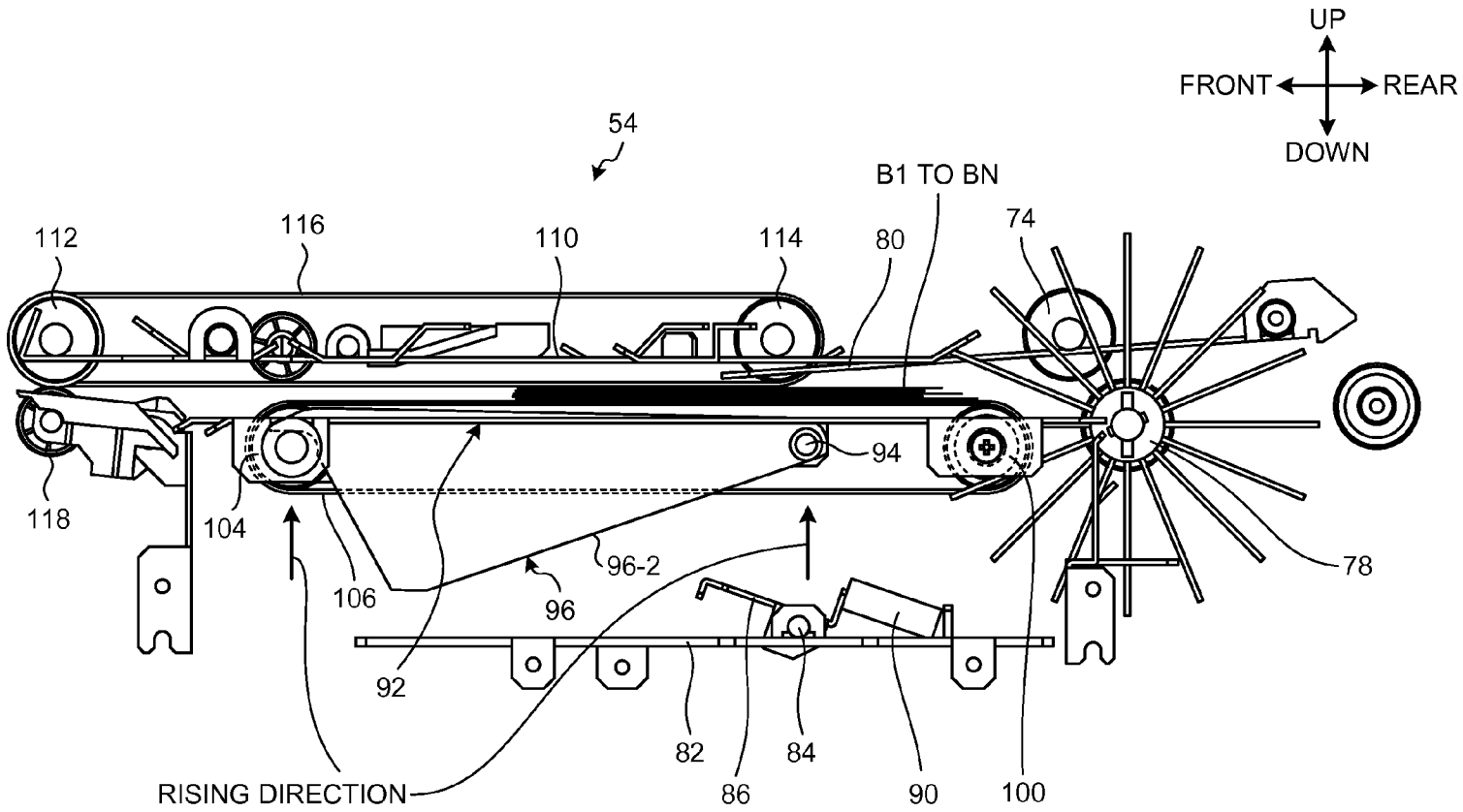
FIG. 11 is an explanatory diagram of an operation of the paper money accumulation unit.

Further, when the stage 92 is further raised, and becomes in the raised state as illustrated in FIG. 11, the paper money layered on the stage 92 is sandwiched between the "upper-side conveyance unit" and the "lower-side conveyance unit". Accordingly, the upper-side conveyance unit and the lower-side conveyance unit arranged in approximately parallel can stably sandwich the layered paper money.

Figure 12:
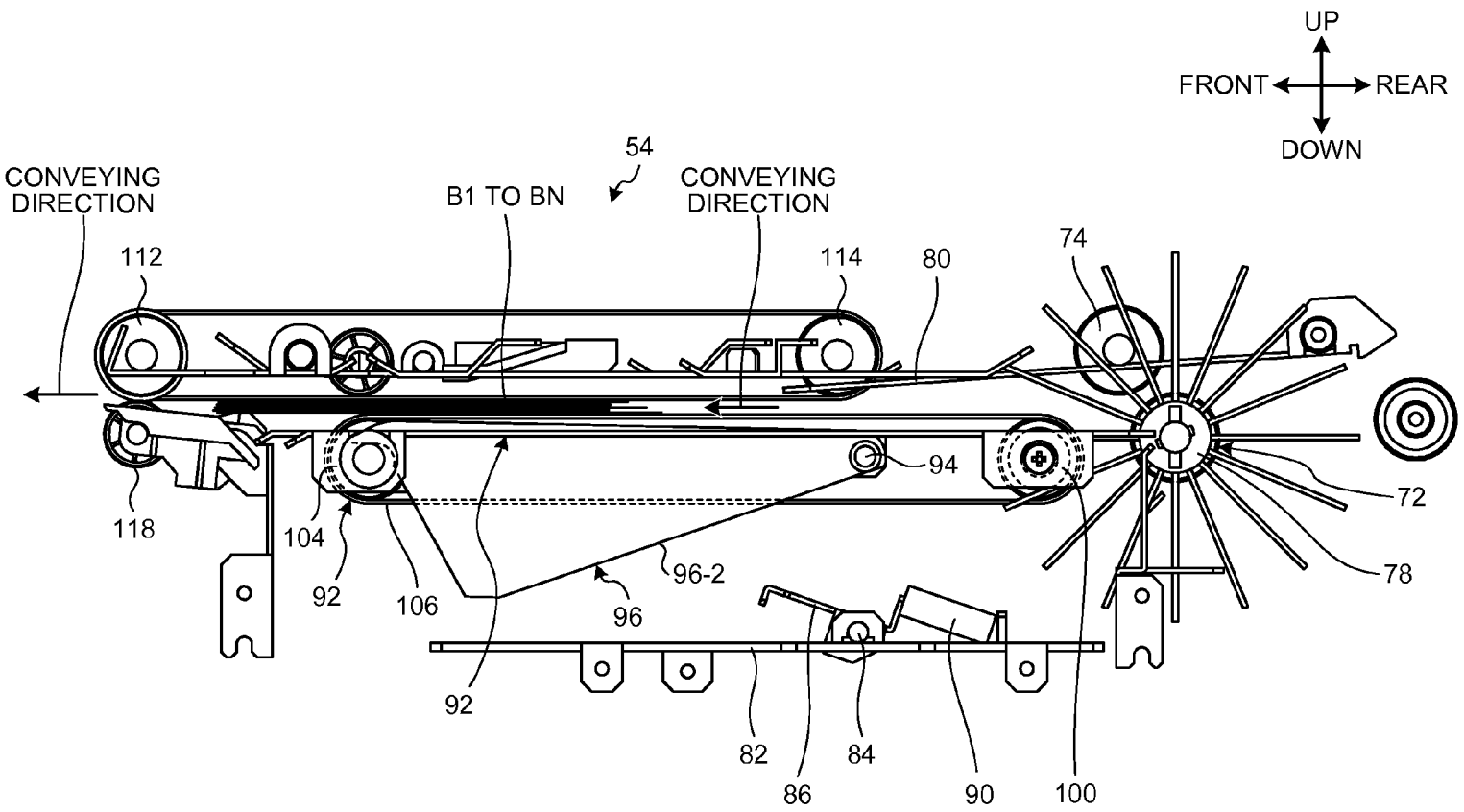
FIG. 12 is an explanatory diagram of an operation of the paper money accumulation unit.

Then, the "upper-side conveyance unit" and the "lower-side conveyance unit" move the layered paper money to the output port including the rollers 118 and 112 in a state of sandwiching the layered paper money, as illustrated in FIG. 12.

As described above, according to the present embodiment, in the paper money accumulation unit (paper money accumulation device) 54, the input unit including the rollers 72 and 74 sequentially input the paper money from an upper side to the paper money accumulation space. Then, the support member 96 is arranged in a state where the height with respect to the extended line of the input direction becomes larger as being away from the rollers 72 and 74 to the input direction of the paper money.

With the configuration of the paper money accumulation unit (paper money accumulation device) 54, even if the paper money having the curling habit is input, the curling of the paper money can be prevented. Accordingly, curled paper money can be prevented from being bent and squashed due to the weight of the paper money, which is input afterward. As a result, a possibility of occurrence of a jam can be decreased, and thus the convenience of the user can be improved.

Further, in the paper money accumulation unit (paper money accumulation device) 54, the energization unit including the energization bar 86 and the spring 90 energize the support member 96 in an upper side direction at the time of inputting the paper money, and moves the support member 96 downward according to the weight of the paper money held (layered) by the support member 96.

With the configuration of the paper money accumulation unit (paper money accumulation device) 54, a paper money layering space can be made large according to the number of layers of the paper money.

Further, in the paper money accumulation unit (paper money accumulation device) 54, the stage 92 has the notched portion 108 through which the support member 96 slips at the time of rising of the stage 92.

With the configuration of the paper money accumulation unit (paper money accumulation device) 54, the upper-side conveyance unit and the lower-side conveyance unit arranged in approximately parallel can stably sandwich the layered paper money in the raised state of the stage 92.

Further, in the paper money accumulation unit (paper money accumulation device) 54, the bar 80 presses the paper money to the stage 92, which is lifted by the stage 92 at the time of rising of the stage 92.

With the configuration of the paper money accumulation unit (paper money accumulation device) 54, even if the inclination of the support member 96 becomes gentle and the paper money becomes easily curled, the curling of the paper money can be prevented.

Another Embodiment

In the first embodiment, the description has been made on the assumption that the paper money accumulation unit (paper money accumulation device) 54 is a dispensing paper money accumulation unit. However, the present technology is not limited to the embodiment, and is applicable to paper money accumulation units for other use.

According to the disclosed embodiments, the convenience of the user can be improved.

All examples and conditional language recited herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A paper money accumulation device comprising:

an input unit that sequentially inputs paper money into a space for accumulating the paper money;

a holding unit that includes a support member arranged in a state where a height with respect to an extended line of an input direction becomes large as being away from the input unit to the input direction of the paper money at a time of inputting the paper money, and that is positioned at a lower side of the space and holds the input paper money with the support member;

a stage that is positioned in a first position at a lower side of the holding unit at the time of inputting the paper money, and that lifts the paper money held in the holding unit by rising from the first position to a second position at a time of outputting the paper money; and an output conveyance unit that includes a first conveyance unit provided on the stage, and a second conveyance unit that moves the lifted paper money between the first conveyance unit and the second conveyance unit to an output port in a state of sandwiching the paper money when the stage is raised to the second position, wherein the stage includes a notched portion through which the support member slips at a time of rising of the stage.

2. The paper money accumulation device according to claim 1, further comprising:

an energization unit that energizes the support member in an upper side direction at the time of inputting the paper money, and moves the support member in a lower side direction according to a weight of the held paper money.

3. The paper money accumulation device according to claim 1, wherein, in the holding unit, one end portion of the support member at a side of the input unit is fixed to the stage with a shaft, and the support member is rotated around the shaft and slips through the notched portion at the time of rising of the stage.

* * * * *